US006044159A

United States Patent [19]

Schmertmann et al.

[11] Patent Number: 6,044,159

[45] Date of Patent: Mar. 28, 2000

[54] PLANAR FILM SPEAKER WITH INERTIAL DRIVER

[76] Inventors: Neil Johan Schmertmann, 11211 S. Military Trail, #44-22, Boynton Beach, Fla. 33436; John Michael McKee, 1236 Hillsboro Mile, B1-204, Hillsboro Beach, Fla. 33062

[21] Appl. No.: 08/992,679

[22] Filed: Dec. 17, 1997

[51] Int. Cl.[7] ..... H04R 25/00

[52] U.S. Cl. ..... 381/186; 381/396

[58] Field of Search ..... 381/151, 186, 381/396, 431

[56] References Cited

U.S. PATENT DOCUMENTS 5,524,061 6/1996 Mooney et al. ..... 381/151
5,546,069 8/1996 Holden et al. ..... 340/407.1

*Primary Examiner*—Curtis A. Kuntz
*Assistant Examiner*—Phylesha Dabney
*Attorney, Agent, or Firm*—Philip P. Macnak

[57] ABSTRACT

A planar film speaker(200) utilizes a first planar film diaphragm (102), and a second planar film diaphragm (104). A taut armature reciprocating impulse transducer (100) is positioned at an edge between the first planar film diaphragm (102) and the second planar film diaphragm (104). A first transmission medium (120) couples the taut armature reciprocating impulse transducer (100) to the first planar film diaphragm (102), and a second transmission medium (122) couples the taut armature reciprocating impulse transducer (100) to the second planar film diaphragm (104). An audio input signal is converted to tactile energy by the taut armature reciprocating impulse transducer (100), which is then converted by the first planar film diaphragm (102) and the second planer film diaphragm (104) into acoustic energy.

15 Claims, 3 Drawing Sheets

PLANAR FILM SPEAKER WITH INERTIAL DRIVER

FIELD OF THE INVENTION

This invention relates in general to speakers, and more specifically to a planar film speaker with an inertial driver.

BACKGROUND OF THE INVENTION

Flat panel, planar speakers have been available for many years. While the performance of such speakers has been generally acceptable, they have not been widely accepted due to their cost. Most flat panel, planar speakers utilize electrostatic transducers to transform the electrical signal into an audible signal. Such electrostatic transducers require very high voltages for their operation, and therefor require additional electrical circuitry to convert the output of a conventional audio amplifier to a signal suitable for driving the electrostatic transducer.

Thus what is needed is a planar speaker which does not require additional electronic circuitry to drive the speaker from a conventional audio amplifier.

DESCRIPTION OF THE PREFERRED EMBODIMENTS

Figure 1:
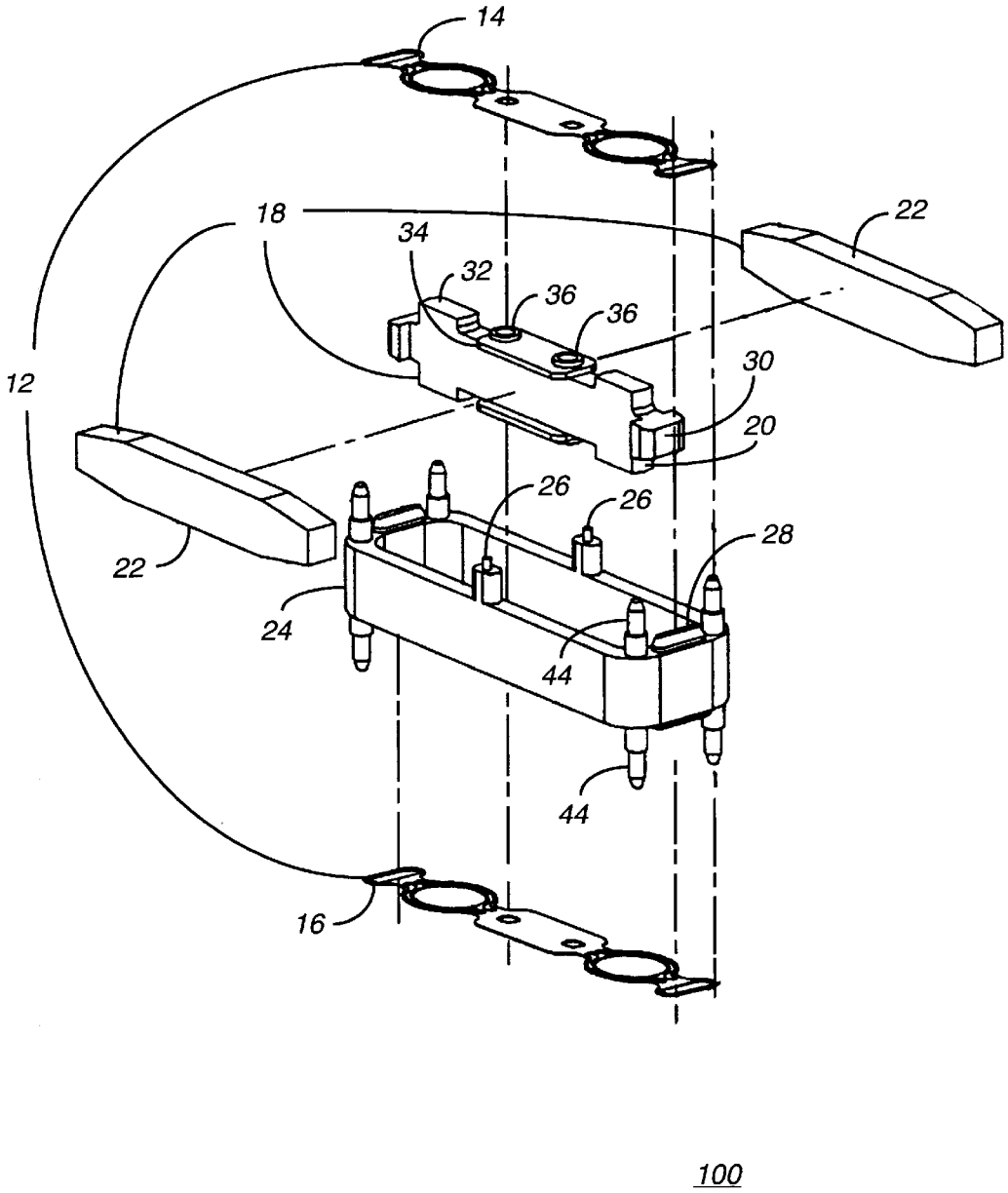
FIG. 1 is an exploded view of a taut armature reciprocating impulse transducer in accordance with the present invention.

FIG. 1 is an exploded view of a taut armature reciprocating impulse transducer 100 in accordance with the present invention. The taut armature reciprocating impulse transducer 100 comprises an armature 12 which includes an upper non-linear suspension member 14 and a lower non-linear resonant suspension member 16, a support frame 24 including a coil 26, and a magnetic motional mass 18 including a magnet mount 20 and two permanent magnets 22, The support frame 24 and the coil 26 (shown only by the coil terminations) in combination are referred to as an electromagnetic driver which is used to effect an alternating electromagnetic field. The electromagnetic driver is preferably manufactured using an injection molding process wherein the coil 26 is molded into the support frame 24, although it will be appreciated that there are other processes for manufacture which can be utilized as well. The upper non-linear suspension member 14 and the lower non-linear suspension member 16 are attached to the support frame 24 by four bosses, of which boss 28 is typical and only three of which are visible.

The magnetic motional mass 18 comprises a magnet support 20 and two permanent magnets 22. The magnet support 20 is shaped to provide end restraints 30 and top to bottom restraints 34 which are used to locate the permanent magnets 22 during assembly to the magnet support 20. The magnet support 20 further includes piers, of which pier 32 is typical, provided to maximize the mass to volume ratio of the magnet support 20 and which fit within the opening of the upper and lower non-linear suspension members 14 and 16. The thickness of the magnet support 20 is reduced at the end restraints 30 to maximize the excursion of the magnetic motional mass 18 during operation. Four flanges, of which two flanges 36 are shown, are used to secure the upper non-linear resonant suspension member 14 and a lower non-linear resonant suspension member 16 to the magnet support 20.

Figure 2:
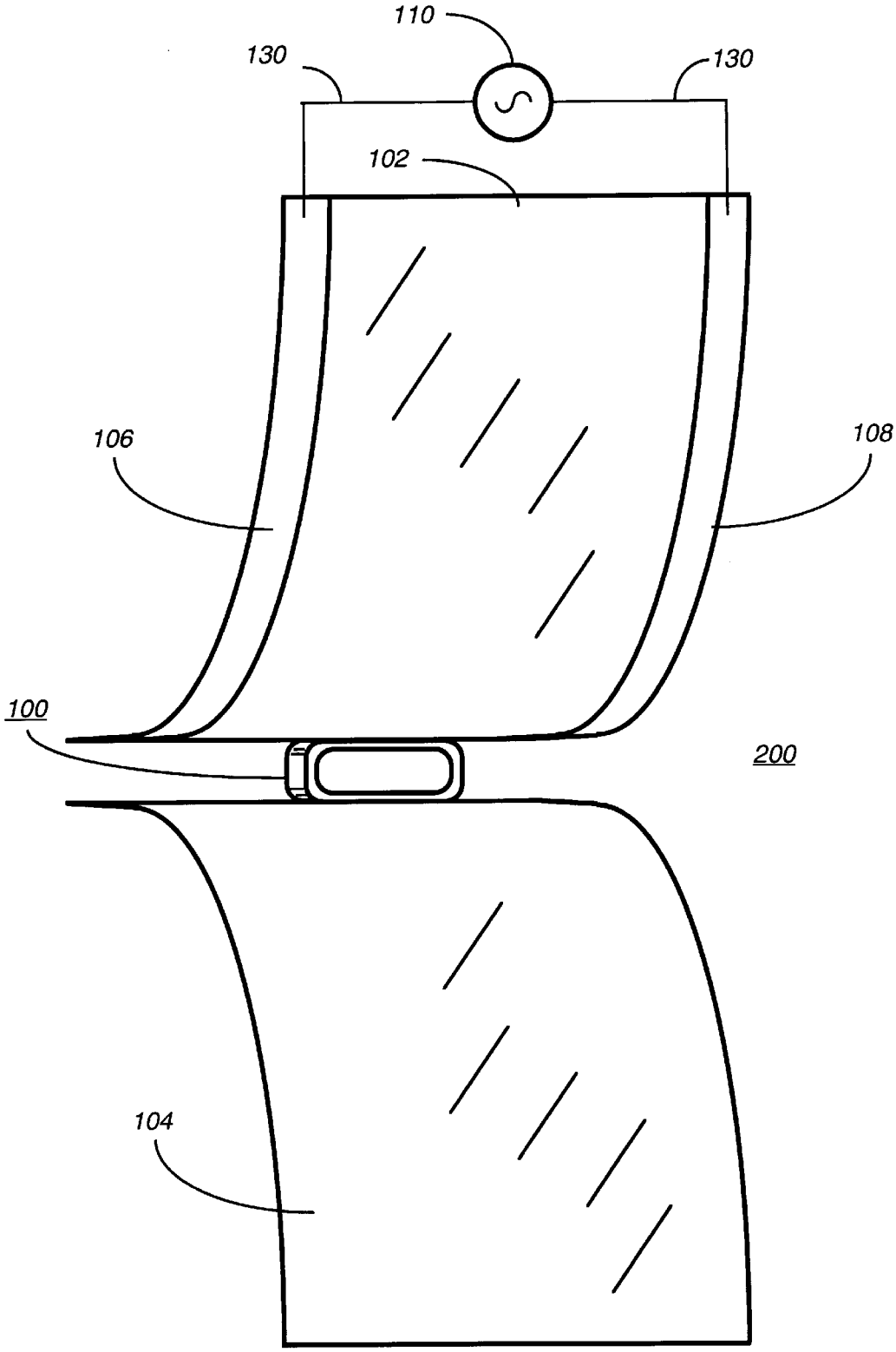
FIG. 2 is an orthographic view of a planar film speaker with inertial driver in accordance with the present invention.

FIG. 2 is an orthographic view of a planar film speaker 200 with inertial driver in accordance with the present invention. The planar film speaker 200 utilizes the taut armature reciprocating impulse transducer 100, described above, and which is described in detail in U.S. Pat. No. 5,546,069 issued Aug. 13, 1996 to Holden et al. which is assigned to the assignee of the present invention and which is incorporated by reference herein. Other taut armature reciprocating impulse transducers suitable for use with the planar film speaker 200 are described in U.S. Pat. application No. 08/515,658 filed Aug. 16, 1995 by Brinkley et al., which is assigned to the assignee of the present invention.

Returning to FIG. 2, the planar film speaker 200 comprises a first planar film diaphragm 102 and a second planar film diaphragm 104 which are coupled to the taut armature reciprocating impulse transducer 100, in a manner to be described below. In the preferred embodiment of the present invention, the planar film diaphragm 102 and a second planar film diaphragm 104 are implemented using an acrylic sheet, which by way of example measures 8 ½ inches by 11 inches (21.6 cm×27.9 cm) on a side and is 0.004 inches thick (0.10 mm). Other polymer materials, such as a polycarbonate film sheet, a mylar film sheet, a Kapton® film sheet can be utilized as well, The terminals of the taut armature reciprocating impulse transducer 100 (not shown in FIG. 1) are coupled to a signal source 110 through conductive runners 106 and 108 which are deposited on the planar film diaphragm 102. The conductive runners 106 and 108 are preferably formed by a reactive sputtering process, or an evaporative deposition process to deposit indium-tin oxide on the planar film sheet in a manner well known in the art. The signal source 110 is coupled to the conductive runners 106 and 108 by means of wires 130. Because of the flexibility of the first planar film diaphragm 102 and a second planar film diaphragm 104, in normal operation the planar film speaker 200 is suspended by the wires 130 so as to allow operation of the planar film speaker when a signal source, such as a power amplifier which is coupled to an AM/FM tuner, a CD player, a turntable, or other source of audio programming, is provided.

Figure 3:
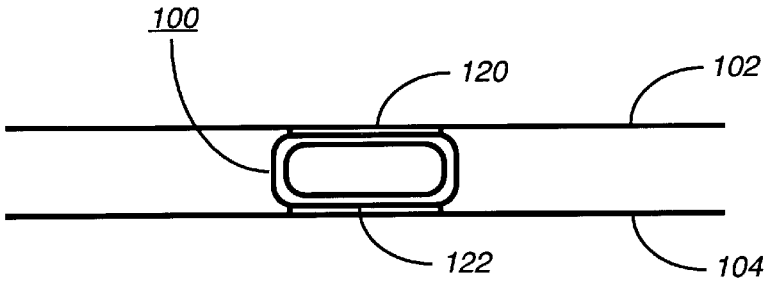
FIG. 3 is a side elevational view planar film speaker with inertial driver in accordance with the present invention.

FIG. 3 is a side elevational view planar film speaker with inertial driver in accordance with the present invention. The taut armature reciprocating impulse transducer 100 is coupled to the first planar film diaphragm 102 through a transmission medium 120, and the second planar film diaphragm 104 through a transmission medium 122. In the preferred embodiment of the present invention, the transmission medium 120 and transmission medium 122 are formed, by way of example from a double sided adhesive foam tape, such as Series 4016 manufactured by 3M Company of St. Paul, Minn. The double sided adhesive firmly attaches the support frame of the taut armature reciprocating impulse transducer 100 to the first planar film diaphragm 102 and the second planar film diaphragm 104.

Figure 4:
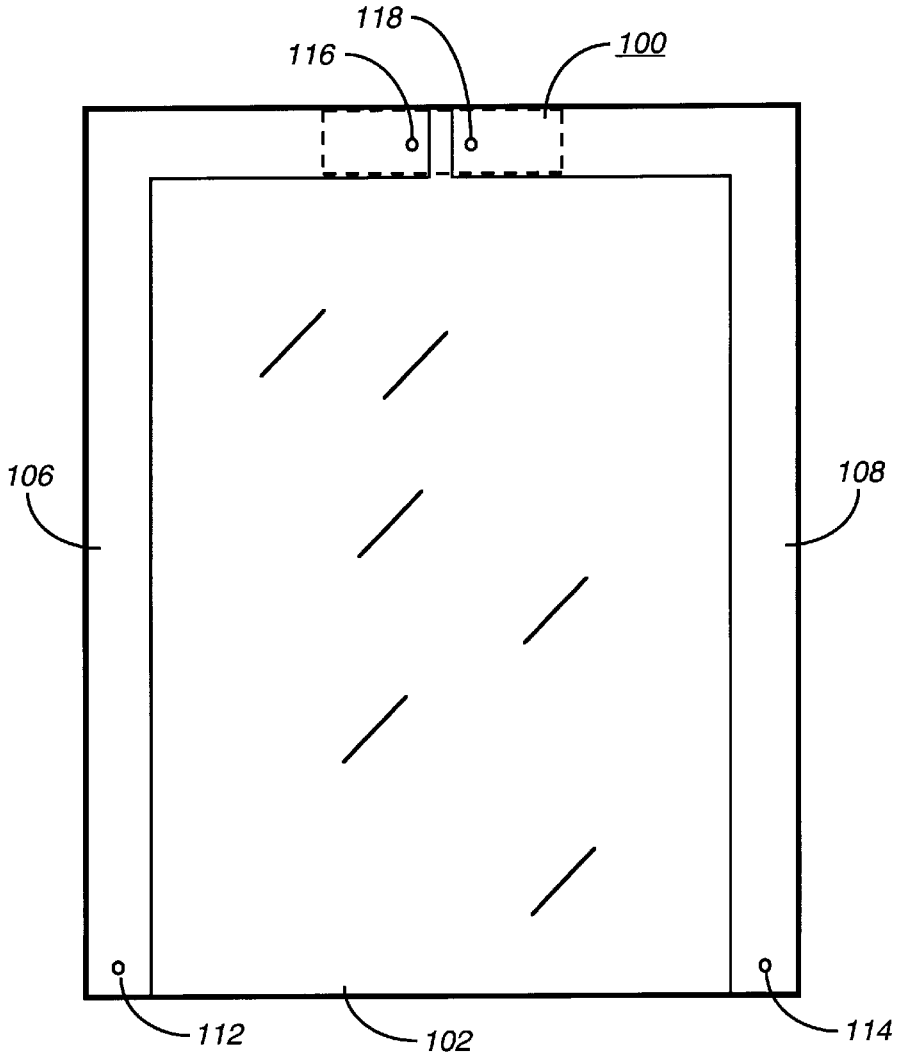
FIG. 4 is a top elevational view planar film speaker with inertial driver in accordance with the present invention.

FIG. 4 is a top elevational view planar film speaker with inertial driver in accordance with the present invention. As can be seen in FIG. 4, the conductive runners 106 and 108 which are formed on the surface of the first planar film diaphragm 102, provide openings 116 and 118 through which leads from the taut armature reciprocating impulse transducer 100 can be brought through to be attached to the conductive runners 106 and 108, respectively. The leads are using a conductive adhesive, such as a conductive epoxy paste, or a low temperature soldering process and low temperature solder paste. It will be appreciated that when the soldering process is utilized, the temperature characteristics of the materials utilized in the planar film diaphragms dictate the temperature at which the solder reflows.

The conductive runners 106 and 108 coupled to the wires 130, also through openings 112 and 114 which are formed in the first planar film diaphragm 102. Attachment of the wires 130 to the conductive runners 106 and 108 can be provided in the manner described above.

In operation, when a signal source is coupled to the taut armature reciprocating impulse transducer 100 of the planar film speaker 200, the tactile energy generated by the motion of the motional mass which is excited, is coupled through the transmission members 120 to the first planar film diaphragm and through the transmission member 122 to the second planar film diaphragm 122. The first planar film diaphragm 102 and the second planar film diaphragm 104 convert the tactile energy which is generated by the taut armature reciprocating impulse transducer 100 into acoustic energy which is coupled through the air to a user listening to the programming which was selected.

A complete description of the electrical characteristics of the taut armature reciprocating impulse transducer 100 can be found is U.S. Pat. No. 5,524,061 issued Jun. 4, 1996 to Mooney et al., entitled "Dual Mode Transducer for a Portable Receiver which is assigned to the assignee of the present invention, and which is incorporated by reference herein.

The planar film speaker described above can be operated from a conventional audio amplifier. Because of the construction of the planar film speaker, there are few limitations as to where the planar film speaker can be operated, i.e. indoors and outdoors. Because of the construction of the taut armature reciprocating impulse transducer, the planar film speaker can also be operated within a number of otherwise hazardous environments. While not shown in the drawings, the planar film speaker can be readily transported from one location to another by simply rolling up the planar film diaphragms into a self-contained tube for transportation.

What is claimed is:

1. A planar film speaker comprising:

a first planar film diaphragm having a pair of conductive runners affixed thereon which couple to a signal source;

a second planar film;

a taut armature reciprocating impulse transducer positioned at an edge between said first planar film diaphragm and said second planar film diaphragm and having an input coupled to said signal source through said pair of conductive runners;

a first transmission medium which couples said taut armature reciprocating impulse transducer to said first planar film diaphragm; and a second transmission medium which couples said taut armature reciprocating impulse transducer to said second planar film diaphragm.

2. The planar film speaker of claim 1 wherein said signal source generates an audio input signal, and wherein said taut armature reciprocating impulse transducer is responsive to the audio input signal to generate tactile energy which is representative of the audio input signal.

3. The planar film speaker of claim 2, wherein said first transmission member and said second transmission member couple the tactile energy into said first planar film diaphragm and said second planar film diaphragm, and wherein said first planar film diaphragm and said second planar film diaphragm convert the tactile energy into acoustic energy which is coupled into the air.

4. The planar film speaker of claim 1 wherein said signal source is an audio power amplifier.

5. The planar film speaker of claim 1 wherein said conductive runners are formed from indium-tin oxide which are evaporatively deposited onto said first planar film diaphragm in a predetermined pattern.

6. The planar film speaker of claim 1, wherein said planar film speaker is suspended during operation by said first planar film diaphragm.

7. The planar film speaker of claim 1, wherein said taut armature reciprocating impulse transducer comprises:

an armature, including upper and lower non-linear suspension members;

an electromagnetic driver, coupled to said upper and lower non-linear resonant suspension members, said electromagnetic driver for effecting an alternating electromagnetic field in response to an audio input signal; and a magnetic motional mass suspended between said upper and lower non-linear resonant suspension members, and coupled to said alternating electromagnetic field for generating an alternating movement of said magnetic motional mass in response thereto, the alternating movement of said magnetic motional mass being transformed through said upper and lower non-linear resonant suspension members and said electromagnetic driver into tactile energy.

8. A planar film speaker comprising:

a first planar film diaphragm formed from a polymer sheet film material;

a second planar film diaphragm formed from a polymer sheet film material;

a taut armature reciprocating impulse transducer positioned at an edge between said first planar film diaphragm and said second planar film diaphragm;

a first transmission medium which couples said taut armature reciprocating impulse transducer to said first planar film diaphragm; and a second transmission medium which couples said taut armature reciprocating impulse transducer to said second planar film diaphragm.

9. The planar film speaker of claim 8, wherein said first planar film diaphragm includes a pair of conductive runners which couple to an input of said taut armature reciprocating impulse transducer and a signal source.

10. The planar film speaker of claim 9, wherein said signal source generates an audio input signal, and wherein said taut armature reciprocating impulse transducer is responsive to the audio input signal to generate tactile energy which is representative of the audio input signal.

11. The planar film speaker of claim 10, wherein said first transmission member and said second transmission member couple the tactile energy into said first planar film diaphragm and said second planar film diaphragm, and wherein said first planar film diaphragm and said second planar film diaphragm convert the tactile energy into acoustic energy which is coupled into the air.

12. The planar film speaker of claim 9, wherein said signal source is an audio power amplifier.

13. The planar film speaker of claim 9, wherein said conductive runners are formed from indium-tin oxide which are evaporatively deposited onto said first planar film diaphragm in a predetermined pattern.

14. The planar film speaker of claim 8, wherein said planar film speaker is suspended during operation by said first planar film diaphragm.

15. The planar film speaker of claim 8, wherein said taut armature reciprocating impulse transducer comprises:

an armature, including upper and lower non-linear suspension members;

an electromagnetic driver, coupled to said upper and lower non-linear resonant suspension members, said electromagnetic driver for effecting an alternating electromagnetic field in response to an audio input signal; and a magnetic motional mass suspended between said upper and lower non-linear resonant suspension members, and coupled to said alternating electromagnetic field for generating an alternating movement of said magnetic motional mass in response thereto, the alternating movement of said magnetic motional mass being transformed through said upper and lower non-linear resonant suspension members and said electromagnetic driver into tactile energy.

* * * * *

UNITED STATES PATENT AND TRADEMARK OFFICE

CERTIFICATE OF CORRECTION

PATENT NO : 6,044,159

DATED : March 28,2000

INVENTOR(S): Schmertmann, et al.

It is certified that error appears in the above-identified patent and that said Letters Patent are hereby corrected as shown below:

Assignee's name unintentionally omitted.

Name of Assignee: MOTOROLA

Residence: Schaumburg, IL

Signed and Sealed this

First Day of May, 2001

*Attest:*

Nicholas P. Godici

NICHOLAS P. GODICI

*Attesting Officer*

*Acting Director of the United States Patent and Trademark Office*